US008892005B2

(12) United States Patent
Lam et al.

(10) Patent No.: US 8,892,005 B2
(45) Date of Patent: Nov. 18, 2014

(54) PRINTER CHARGING BLADES AND PRINTERS

(75) Inventors: Quang P. Lam, Hayward, CA (US); Michael H. Lee, San Jose, CA (US); Omer Gila, Cupertino, CA (US); Thomas C. Anthony, Sunnyvale, CA (US); Seongsik Chang, Santa Clara, CA (US); Paul F. Matheson, Pennsgrove, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 225 days.

(21) Appl. No.: 13/459,509

(22) Filed: Apr. 30, 2012

(65) Prior Publication Data

US 2013/0287443 A1 Oct. 31, 2013

(51) Int. Cl.
*G03G 15/02* (2006.01)

(52) U.S. Cl.
USPC ..... 399/174

(58) Field of Classification Search
CPC ..... G03G 15/0216; G03G 15/0225; G03G 15/0233
USPC ..... 399/174
See application file for complete search history.

(56) References Cited

U.S. PATENT DOCUMENTS

| | | | | |
|---|---|---|---|---|
| 5,842,081 | A * | 11/1998 | Kaname et al. | 399/50 |
| 5,940,660 | A * | 8/1999 | Saito | 399/174 |
| 5,997,772 | A | 12/1999 | Cornelius et al. | |
| 6,253,052 | B1 | 6/2001 | Cornelius et al. | |
| 6,553,192 | B2 | 4/2003 | Maebashi | |
| 7,177,572 | B2 | 2/2007 | DiRubio et al. | |
| 7,295,796 | B1 | 11/2007 | Murakami et al. | |
| 7,308,212 | B2 | 12/2007 | Hamada et al. | |
| 2010/0061747 | A1 | 3/2010 | Choi | |
| 2011/0200362 | A1 | 8/2011 | Gilmartin et al. | |

FOREIGN PATENT DOCUMENTS

| | | |
|---|---|---|
| JP | 2007292996 | 11/2007 |
| JP | 2011107532 | 6/2011 |

* cited by examiner

*Primary Examiner* — Walter L Lindsay, Jr.
*Assistant Examiner* — Barnabas Fekete

(57) ABSTRACT

Printer charging blades and printers are disclosed. An example charging blade for a printer includes an insulating layer to contact a photo imaging surface at an angle to apply pressure to the photo imaging surface, the pressure to control an amount of material present on the photo imaging surface, and a conductive layer attached to a side of the insulating layer, the conductive layer to be charged and to apply a first charge to the photo imaging surface.

19 Claims, 7 Drawing Sheets

PRINTER CHARGING BLADES AND PRINTERS

BACKGROUND

Some printers use photo imaging plates to develop and apply ink images to print substrates. These photo imaging plates are initially provided with a uniform charge, which is thereafter selectively reduced or removed in locations where ink is to be applied (or not applied). One manner in which a uniform charge has been provided to photo imaging plates is using a charge roller. The charge roller used in the HP Indigo Series III printer is a conductive urethane roller that substantially uniformly charges the photo imaging plate surface.

DETAILED DESCRIPTION

Figure 1:
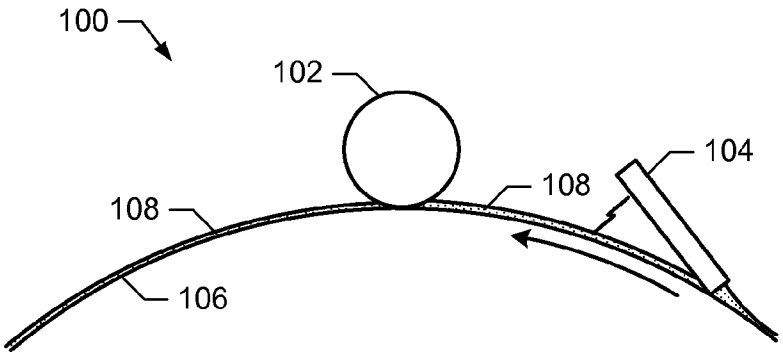
FIG. 1 illustrates an example printer constructed in accordance with the teachings of this disclosure including a charge roller and a charging blade.

In known printers, a charge roller rolls along the surface of a photo imaging plate and places most of the charges prior contacting the surface (e.g., at a pre-nip location, the nip being the spot at which the charge roller physically contacts the photo imaging plate). The amount of current flowing through the material making up the charge roller causes ions to move. This process causes the material to deteriorate over time, and eventually requires the charge roller to be replaced to maintain acceptable print image quality. The consumption of charge rollers adds a significant cost per printed page for printers in which they are implemented.

Past efforts to increase the roller lifetime has been complicated by the complexity of the charge roller material. In addition, presently-used rollers may include proprietary material formulations. Thus, increasing charge roller lifetime has a direct impact on cost per printed page.

Example printer charging blades, printers, and methods to provide printers with charging blades disclosed herein provide charging to the photo imaging plate prior to charging via the charge roller. As a result, the role of the charge roller in example printer charging blades, printers, and methods to provide printers with charging blades is decreased from primary charging responsibility to charge leveling. Thus, the current through the charge roller is much smaller in the disclosed examples than in known printers, thereby significantly reducing stress on the charge roller material, substantially increasing its useful life, and reducing cost per printed page.

Example printer charging blades, printers, and methods to provide printers with charging blades disclosed herein are significantly less expensive to produce, replace, and/or implement relative to known charge rollers. As a result, the charging blade can be replaced at significantly less cost than replacing the charge roller. Additionally, the use of example printer charging blades, printers, and/or methods to provide printers with charging blades disclosed herein extends the life of the charge roller.

Example printer charging blades disclosed herein include an insulating layer to contact a photo imaging surface at an angle to apply pressure to the photo imaging surface. The pressure controls an amount of material present on the photo imaging surface in the area subsequent to the blade (e.g., in the direction of rotation of the photo imaging surface). The example printer charging blades further include a conductive layer attached to a side of the insulating layer. The example conductive layer is charged and applies a charge to the photo imaging surface.

Example printers disclosed herein include a charging blade to apply a first charge to the photo imaging surface, and a charge roller downstream of the charging blade to apply a second charge to the photo imaging surface to modify the first charge on the photo imaging surface.

In some examples, the contact between the printer charging blade occurs prior to (e.g., less than one half-rotation of the photo imaging surface before) a location of the charge roller in the direction of travel of the photo imaging surface. In some examples, the charging blade applies a majority of the charge to be placed on the photo imaging surface, and the charge roller levels (e.g., evens, smoothes) the charge placed by the charging blade to result in a uniform charge being applied to the photo imaging surface.

At least some examples herein facilitate a significant extension the useful lifetime of the charge rollers without sacrificing print quality. For example, some known charge rollers have a reported lifetime of up to 500,000 impressions when passing a net current of about 1.1 milliamperes (mA). However, charge rollers of the same formulation can last up to one million impressions or more when operating at 0.6 mA instead of 1.1 mA. Some examples of printer charging blades, printers, and methods to provide printers with charging blades disclosed herein can facilitate operation of charge rollers at a current level of about 10 microamperes (μA). A reduced operating current generally implies a higher lifetime of the charge roller.

Example voltages and currents are used in the examples described above and below. These voltages and currents are used for illustration purposes only, and are not intended to limit the scope of the examples to particular voltages, currents, and/or ranges of voltages and/or currents.

As used herein, the term "photo imaging surface" refers to an electrophotographic surface, such as a photo imaging plate, that may be electrically charged and/or discharged by applying light to the electrophotographic surface. Photo imaging surfaces include any type of electrophotographic surfaces used in printers or similar imaging devices.

FIG. 1 illustrates an example printer 100 including a charge roller 102 and a charging blade 104. The example printer 100 of FIG. 1 includes a photo imaging plate 106 (e.g., a photo imaging surface, an electrophotographic surface, etc.) having a cylindrical (or drum) shape. The example printer 100 charges the photo imaging plate 106 via the charge roller 102 and the charging blade 104, and develops a latent image on the photo imaging plate 106 by selectively removing charges from portion(s) of the photo imaging plate 106. This latent image is then used to collect and deliver ink particles to a print substrate to form the image on the substrate.

The example charging blade 104 of FIG. 1 controls an amount of a material 108 present on the photo imaging plate 106. The charging blade 104 also applies a first charge to the photo imaging surface 106. For example, if the charge to be applied to the photo imaging plate 106 is −1000 Volts (V), the charging blade 104 may apply less (e.g., closer to 0) charge, in which case the photo imaging plate 106 is provided with a likewise lower charge, for example, a −900 V charge. In such examples, the charge roller 102 provides the additional charge to the photo imaging plate 106 (e.g., an additional −100 V) to result in the correct charge.

In some other examples, the charging blade 104 provides approximately the charge to be applied to the photo imaging plate 106 (e.g., −1000 V +/−50 V, −1000 V +/−5 V, etc.). In these examples, the charge roller 102 may increase and/or decrease the charge present on sections of the photo imaging plate 106 to result in a substantially uniform charge across the photo imaging plate 106. These examples advantageously enable the current of the charge roller 102 to be significantly reduced compared to prior art charge rollers (for example, to 10 μA), thereby substantially extending its usable life. Additionally, because the role of the charge roller 102 may be changed to merely leveling (e.g., balancing) the charge on the photo imaging plate 106, different (e.g., less expensive) materials may be used to implement the charge roller 102 when used in combination with the charging blade 104.

Figure 2:
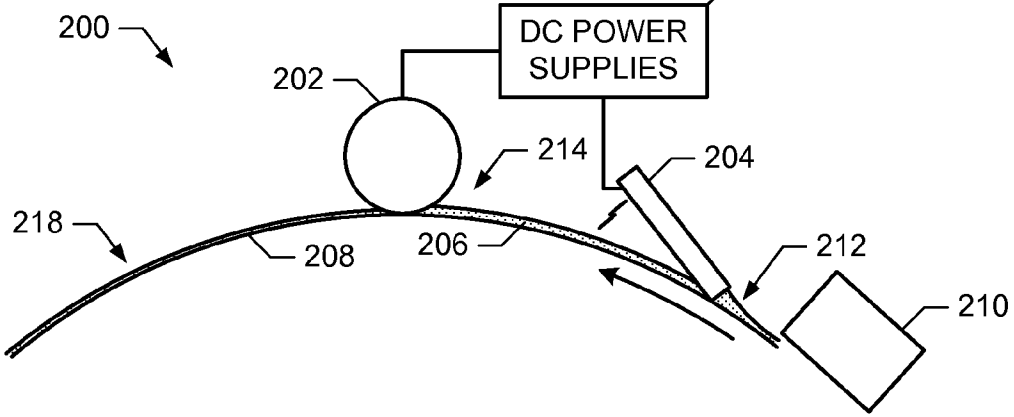
FIG. 2 illustrates another example printer constructed in accordance with the teachings of this disclosure including a charge roller, a charging blade, and imaging oil.

FIG. 2 illustrates another example printer 200 including a charge roller 202, a charging blade 204, and imaging oil 206. A charge is applied to a photo imaging plate 208.

The example illustrated in FIG. 2 further includes a cleaning station 210. The example cleaning station 210 of FIG. 2 cleans the photo imaging plate 208 subsequent to the photo imaging plate 208 applying an image to a substrate. As used herein, the term "subsequent" to applying an image is used with reference to an angular section of the rotating cylindrical photo imaging plate 208 (i.e., refers to downstream in the direction of rotation of the plate 208). For example, one angular (e.g., radial) section of the photo imaging plate 208 may apply a first portion of the image and rotate to the cleaning station 210 while another angular section of the photo imaging plate 208 is applying a second portion of the same image to the substrate.

To clean the photo imaging plate 208, the example cleaning station 210 of FIG. 2 removes ink remaining on the photo imaging plate 208 (e.g., ink not transferred to the print substrate) and applies a coating of imaging oil 206 to the photo imaging plate 208. The example imaging oil 206 is a petroleum hydrocarbon and/or refined petroleum hydrocarbon. While a thin, even coating of imaging oil 206 is preferred for increasing print quality, the example cleaning station 210 of FIG. 2 does not apply such a thin, even coating. As a result, sections of the photo imaging plate 208 (e.g., a section 212) leave the cleaning station 210 with a relatively thick layer of the imaging oil 206.

In some examples, the cleaning station 210 reduces (e.g., removes) charge from the photo imaging plate 208 that remains subsequent to applying the ink to the substrate. Such reducing and/or evening the charge on the photo imaging plate 208 may result in a more even charging (e.g., recharging) of the photo imaging plate 208 by the charging blade 204 and/or the charge roller 202.

The example charging blade 204 of FIG. 2 applies a pressure to the photo imaging plate 208 to reduce the thickness of the layer of imaging oil 206. As a result, sections of the photo imaging plate 208 (e.g., a section 214) subsequent to the charging blade 204 have a thinner, more even coating of the imaging oil 206 than the example section 212.

In addition to thinning and evening the imaging oil 206, the example charging blade 204 applies a charge to the photo imaging plate 208. In the example of FIG. 2, the photo imaging plate 208 is to be charged to approximately −1000 V. The example charging blade 204 is provided with a charge or voltage (e.g., from a direct current (DC) power supply 216) of approximately −1500 V.

The example charging blade 204 of FIG. 2 charges the photo imaging plate 208 primarily via plasma discharge. The charge applied to the example charging blade 204 is based on the resulting charge to be applied to the photo imaging plate 208 (e.g., the net desired charge of −1000 V, less than the net desired charge, −900 V, etc.), the speed of rotation of the photo imaging plate 208 (e.g., the printer speed), the conductivity of the imaging oil 206, and/or the distance between the portion of the charging blade 204 that is to charge the photo imaging plate 208.

In the example of FIG. 2, the layer of imaging oil 206 may have a tendency to coat a side 218 of the charging blade 204 facing the photo imaging plate 208. The side 218 is the portion of the charging blade 204 that is to charge the photo imaging plate 208 in the example of FIG. 2. The imaging oil 206 is believed to provide a dielectric boundary to prevent localized high current discharge (e.g., electrical arcing) from the charging blade 204 to the photo imaging plate 208. Such localized high current discharge can usually be observed visually as a spark and may damage the photo imaging plate 208. Damage to the photo imaging plate 208 reduces (e.g., eliminates) the ability of the damaged portion(s) to hold charge, which likewise reduces (e.g., eliminates) the ability of the photo imaging plate 208 to reproduce the respective portion of an image onto a substrate. Thus, this damage is highly undesirable and the coating of the charging blade 204 by the imaging oil 206 is advantageous.

The example charging blade 204 of FIG. 2 may be used as a replacement for the scraping blade in known printers. An example method to provide the printer 200 with the charging blade is described below with reference to FIG. 10.

The example charge roller 202 of FIG. 2 applies a second charge to the photo imaging plate 208 to modify (e.g., increase, decrease, and/or even) the charge on the photo imaging plate 208 (e.g., the charge present on the section 214). Thus, the example charge roller 202 modifies the charge applied to the photo imaging plate 208 by the charging blade 204. In the example of FIG. 2, the charge applied to and/or removed from the photo imaging plate 208 by the charging roller 202 is substantially reduced, compared to the charge applied to photo imaging surfaces in known printers, and is replaced with the application of charge by the charging blade 204.

The example charge roller 202 also applies physical pressure to the example photo imaging plate 208. The physical pressure further reduces the thickness of the imaging oil 206 present on the photo imaging plate 208 (e.g., on a section 220 of the photo imaging plate 208) relative to the section 214.

The example charging blades 104 and 204 of FIGS. 1 and 2 may include an insulating layer (e.g., to contact the photo imaging plates 106, 208 to control an amount of oil, etc.) and a conductive layer (e.g., to charge the photo imaging plates 106, 208). Examples of such charging blades are described in more detail below. In some other examples, the charging blades 104 and 204 include a layer that both controls the thickness of the imaging oil layer (e.g., applies pressure to the photo imaging plate 106, 208), and is at least partially conductive to charge the photo imaging plate. Such an example layer may be constructed using, for example, carbon black-loaded or carbon black-doped urethane. When used in combination with a charge roller (e.g., the charge rollers 102 and 202 of FIGS. 1 and 2), a charging blade 104, 204 may be implemented inexpensively compared to replacing the charge roller. Furthermore, the charging blade 104, 204 may be implemented without needing to uniformly charge the photo imaging plate 106, 208 via the charging blade 104, 204 (e.g., by evening the charge via the charge roller 102, 202).

Figure 3:
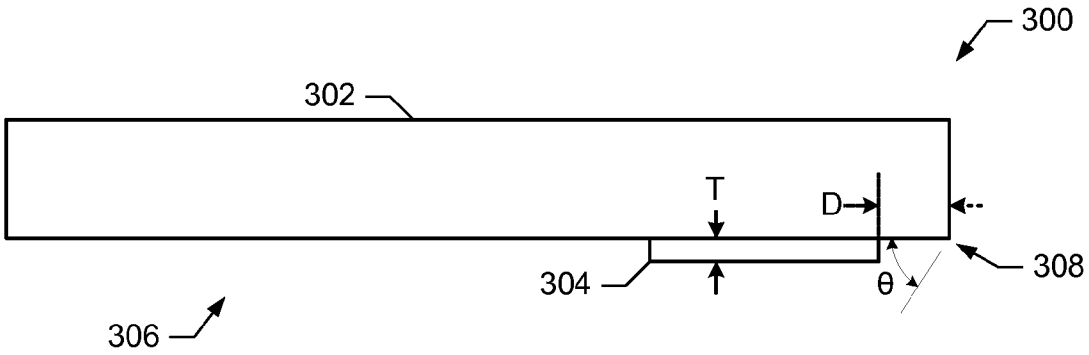
FIG. 3 illustrates an example charging blade constructed in accordance with the teachings of this disclosure.

FIG. 3 is an example charging blade 300 constructed in accordance with the teachings of this disclosure. The example charging blade 300 of FIG. 3 may be used to implement either of the example charging blades 104, 204 of FIGS. 1 and/or 2.

The example charging blade 300 of FIG. 3 includes an insulating layer 302 and a conductive layer 304. The example insulating layer 302 is to contact a photo imaging surface (e.g., the photo imaging plates 106, 208 of FIGS. 1 and/or 2) at an angle to apply pressure to the photo imaging plate 106, 208. The applied pressure controls an amount of material (e.g., imaging oil) present on the photo imaging plate 106, 208.

The example conductive layer 304 is attached to (e.g., affixed, integral to, detachable from, etc.) a side 306 of the insulating layer 302 adjacent the surface or edge to contact the plate 106, 208. The example conductive layer 304 is to be electrically charged and is to apply a first electrical charge to the photo imaging plate 106, 208.

Advantageously, the example charging blade 300 is capable of charging beyond the Paschen threshold (e.g., about −560 V between the conductive layer 304 and a photo imaging plate). In some such examples, the bulk of the charging occurs via plasma discharge, while approximately 10% of the charging (e.g., charging occurring before the Paschen threshold is reached) occurs via ionic conduction. It is believed that the ionic conduction results from imaging oil coating the conductive layer 304 and/or the insulating layer 302 during operating of a printer including the charging blade 300. The use of both plasma discharge charging and ionic conduction charging advantageously enables a lower voltage to be applied to the conductive layer 304 to apply the same amount of charge to the photo imaging plate (e.g., −1.5 kV DC instead of −1.6 kV DC to charge the photo imaging plate surface to −1 kV).

The thickness T of the conductive layer 304 determines the distance D the conductive layer is to be placed from the contact (e.g., corner) edge 308 of the insulating layer 302. In the example of FIG. 3, the conductive layer 304 is positioned to maintain a distance of 10-20 μm from the photo imaging plate when installed in a printer. At an engagement angle θ of 5 degrees between the insulating layer 302 and the photo imaging plate, a conductive layer 302 that has a thickness T of 80 μm is placed approximately 1 mm, and is no more than 1.25 mm, from the contact edge 308.

Figure 4:
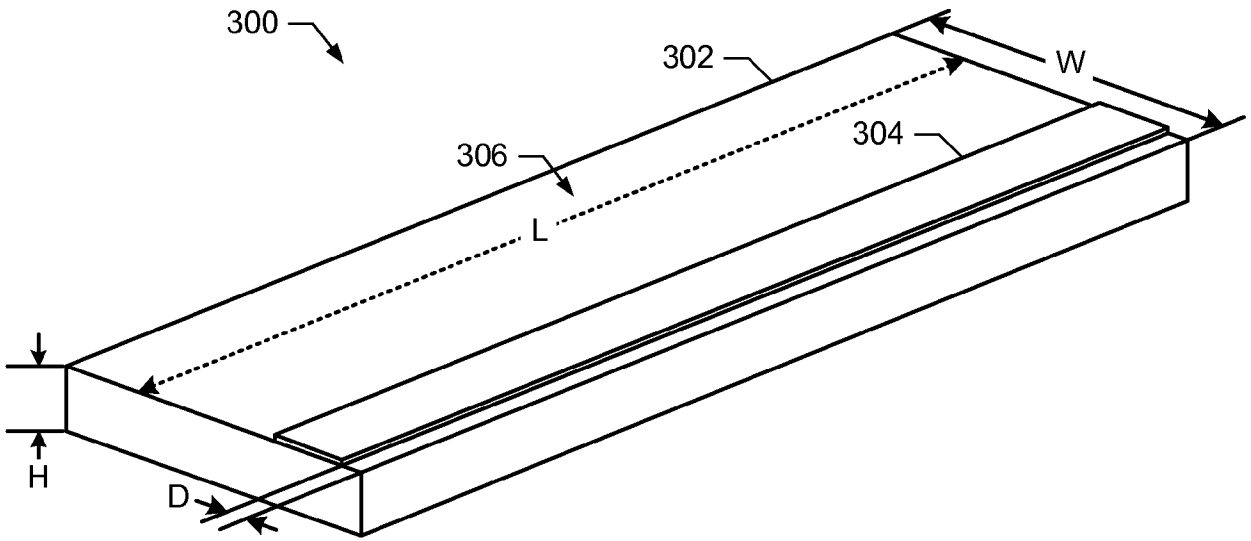
FIG. 4 is a perspective view of the example charging blade of FIG. 3.

FIG. 4 is a perspective view of the example charging blade 300 of FIG. 3. In some examples, the insulating layer 302 is 30 mm wide (W) by 345 mm long (L) and 3 mm thick (H). The example conductive layer 304 is a conductive (e.g., metallic) strip that extends along the length L of the insulating layer 302. In the example of FIGS. 3 and 4, the length L is selected to extend over a width of the photo imaging surface (e.g., the widths of the photo imaging plates 106, 208).

The example conductive layer 304 is placed a distance D from a leading (e.g., contact) edge to reduce (e.g., prevent) contact between the conductive layer 304 and the photo imaging plate 106, 208, to thereby avoid potential damage to the photo imaging plate 106, 208. The distance D is based on the angle at which the example insulating layer 302 contacts the photo imaging plate 106, 208 as explained above.

Figure 5:
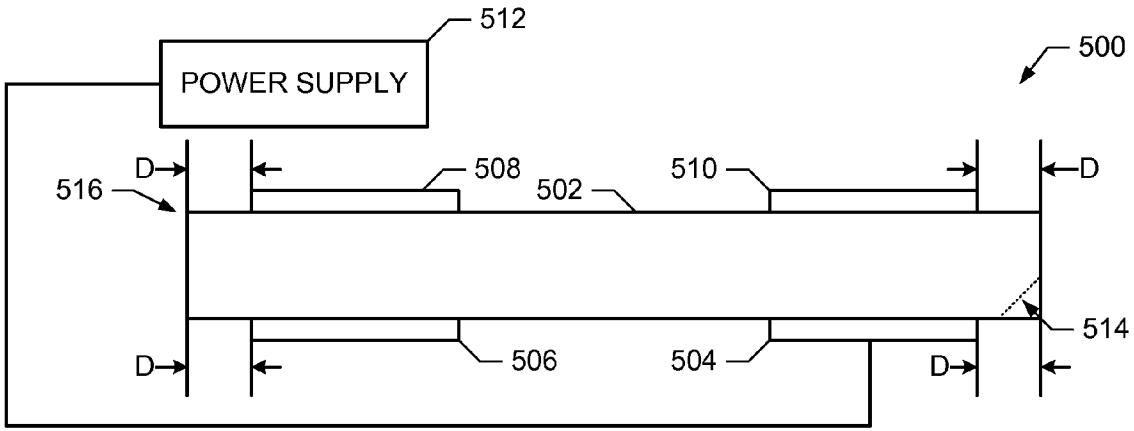
FIG. 5 illustrates another example charging blade constructed in accordance with the teachings of this disclosure.
Figure 6:
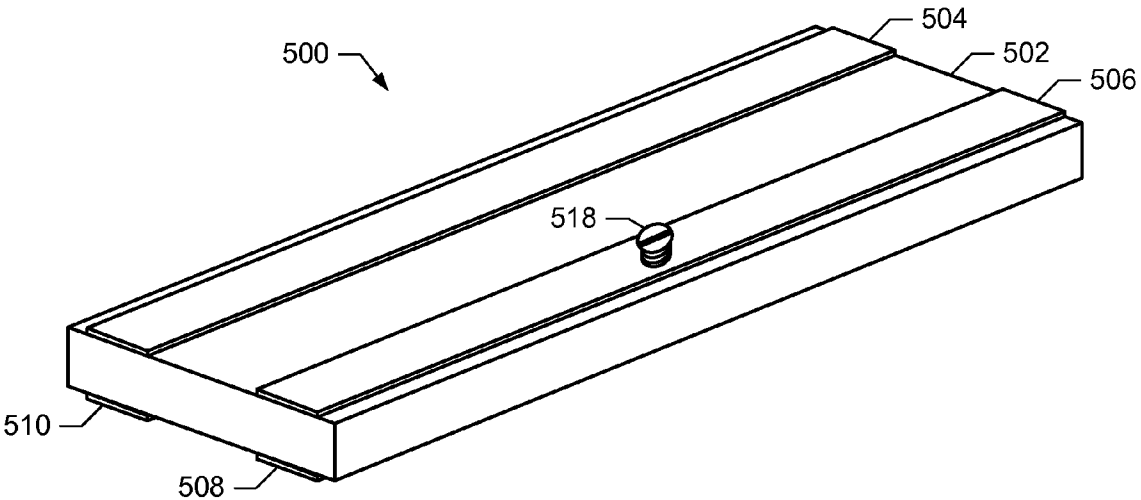
FIG. 6 is a perspective view of the example charging blade of FIG. 5.

FIG. 5 is another example charging blade 500 constructed in accordance with the teachings of this disclosure. FIG. 6 is a perspective view of the example charging blade 500 of FIG. 5. The example charging blade 500 includes an insulating layer 502 and multiple conductive layers 504, 506, 508, 510. Each of the example conductive layers 504-510 of FIGS. 5 and 6 is a metallic strip (e.g., stainless steel). A power supply 512 is electrically coupled to at least one of the conductive layers (e.g., the conductive layer 504) that is adjacent (e.g., closest to) an edge of the insulating layer 502. The power supply 512 provides charge to the conductive layer(s) 504-510 to charge a photo imaging surface (e.g., the photo imaging plates 106, 208 of FIGS. 1 and/or 2).

In contrast to the charging blade 300 of FIGS. 3 and 4, the charging blade 500 may be used in multiple configurations prior to replacement. As a leading edge (e.g., corner) of the charging blade 500 wears out (e.g., illustrated by the dotted line 514 of FIG. 5), the insulating layer 502 may lose its effectiveness at reducing a layer of imaging oil (e.g., between the thickness of the imaging oil 206 from section 212 to section 214 of FIG. 2).

When the effectiveness of the insulating layer is reduced beyond a threshold, the example charging blade 500 may be rotated and/or flipped to use another edge (e.g., corner) of the insulating layer 502 as the leading edge. The example conductive layer (e.g., the conductive layer 508) adjacent the new leading edge (e.g., the edge 516) is then connected to the power supply 512.

As illustrated in FIG. 6, each example conductive layer 504 includes a fastener 518. The fastener 518 fastens an electrical coupling from the power supply 512, such as a wire, to the conductive layer 504 to electrically couple the layer 504 to the power supply 512. In some examples, the fastener 518 is unfastened from the conductive layer 504 and fastened to the next conductive layer (e.g., the conductive layer 508) when the charging blade 500 is rotated and/or flipped. In some other examples, each of the example conductive layers 504-510 is provided with a fastener. While the example of FIG. 6 uses a fastener 518, the conductive layers 504-510 may be electrically coupled to the example power supply 512 via any other method or device for electrically coupling two or more devices.

Figure 7:
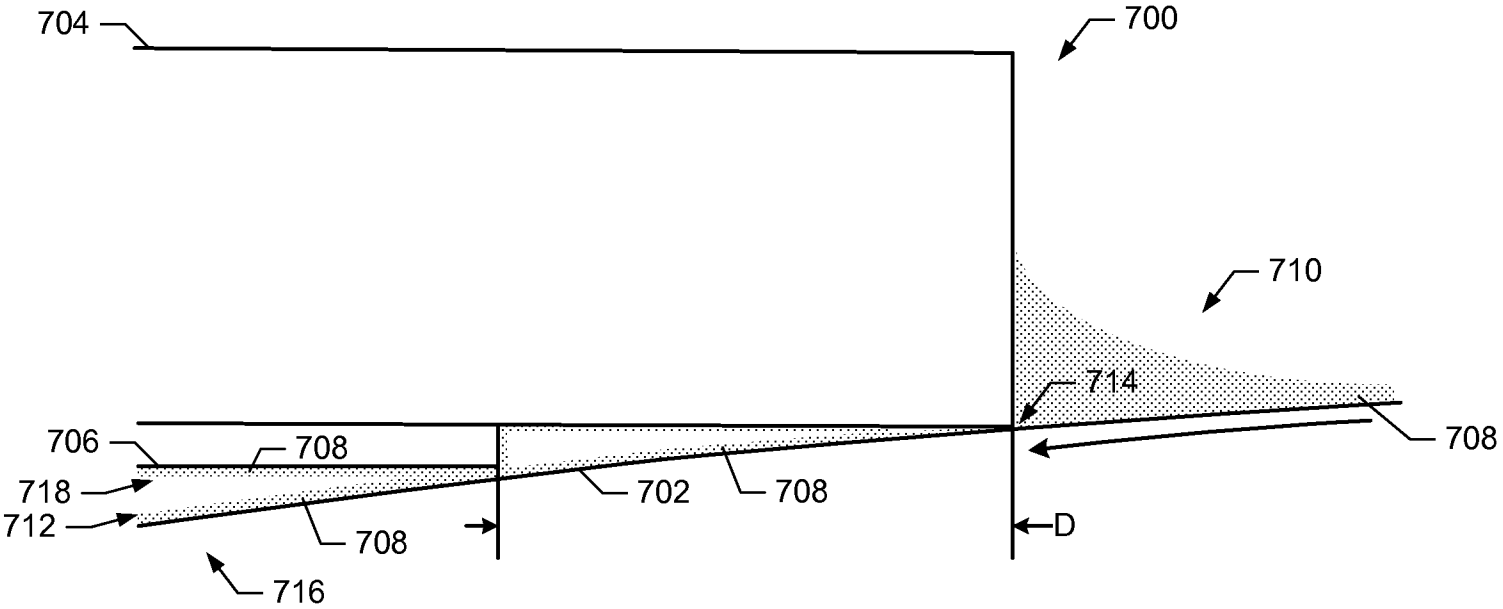
FIG. 7 is a partial side view of an example charging blade adjacent a photo imaging plate.

FIG. 7 is a partial side view of an example charging blade 700 adjacent a photo imaging plate 702. The example charging blade 700 may be any of the example charging blades 104, 204, 300, 500 of FIGS. 1-6. The example charging blade 700 includes an insulating layer 704 and a conductive layer 706. The insulating layer 704 is substantially in contact with the photo imaging plate 702 (e.g., in contact, with a thin layer of imaging oil 708 between the insulating layer 704, while the conductive layer 706 does not contact the photo imaging plate 702.

In the region 710 of the photo imaging plate 702 prior to the charging blade 700 (e.g., in the illustrated counterclockwise direction of the photo imaging plate 702), the photo imaging plate 702 is coated with a relatively thick layer of the imaging oil 708. The pressure applied by the insulating layer 704 to the photo imaging plate 702 (e.g., at the nip or contact point 714) reduces the thickness of the layer of imaging oil 708, resulting in a thinner layer 712 of the imaging oil 708 in the region 716 (e.g., subsequent to the nip 714).

As illustrated in FIG. 7, the imaging oil 708 also creates a dielectric layer 718 over the conductive layer 706. The dielectric layer 718 may be formed by, for example, capillary movement of the imaging oil 708 from the nip 714 to the conductive layer 706 via the insulating layer 704. The dielectric layer 718 may result in ionic conduction to provide at least a portion of the charging to the photo imaging plate 702. Furthermore, the dielectric layer 718 reduces the probability of (e.g., prevents) localized high current discharge (e.g., electrical arcing) between the photo imaging plate 702 and the conductive layer 706.

Figure 8:
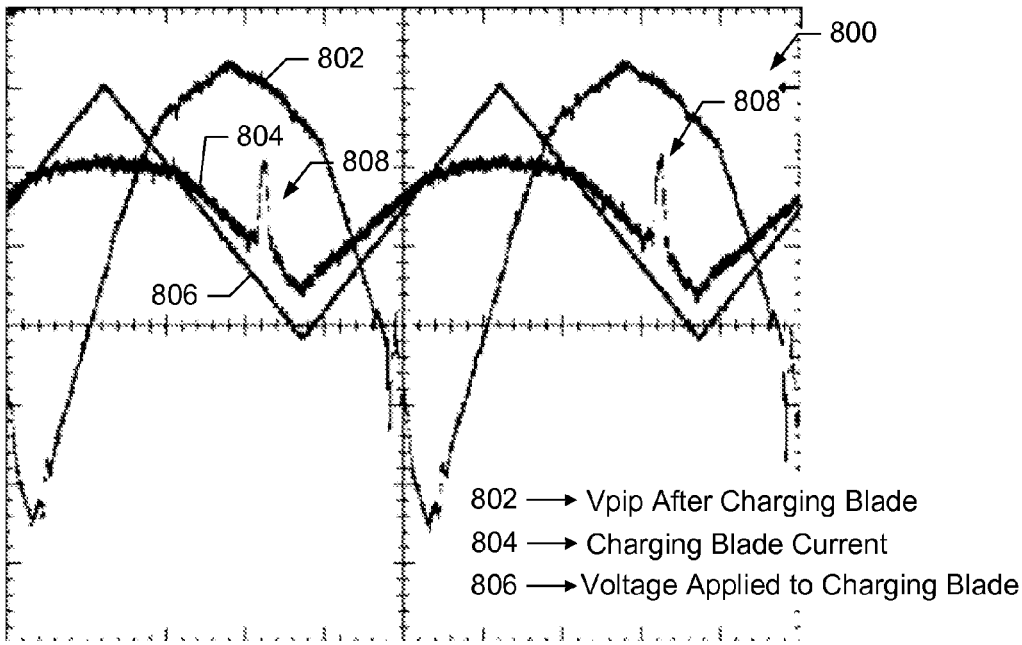
FIG. 8 is a graph of example voltages and/or currents during operation for a charging blade and a photo imaging plate

FIG. 8 is a graph 800 of example voltages and/or currents during operation for a charging blade (e.g., any of the charging blades 104, 204, 300, 500, 700 of FIGS. 3-7) and a photo imaging plate. The example graph 800 illustrates the voltage 802 of the photo imaging plate subsequent to being charged by the charging blade, the current 804 drawn by the charging blade (e.g., applied to charging the photo imaging plate), and the voltage 806 applied to the charging blade.

As demonstrated in FIG. 8, as the example charging blade operating voltage varies, the charging blade current 804 has no indication of spikes that are indicative of electrical arcing (e.g., localized high current discharge). Furthermore, the current ramp 804 is smooth throughout the operating range and across a seam in the photo imaging plate (illustrated by the brief current spikes 808).

Figure 9:
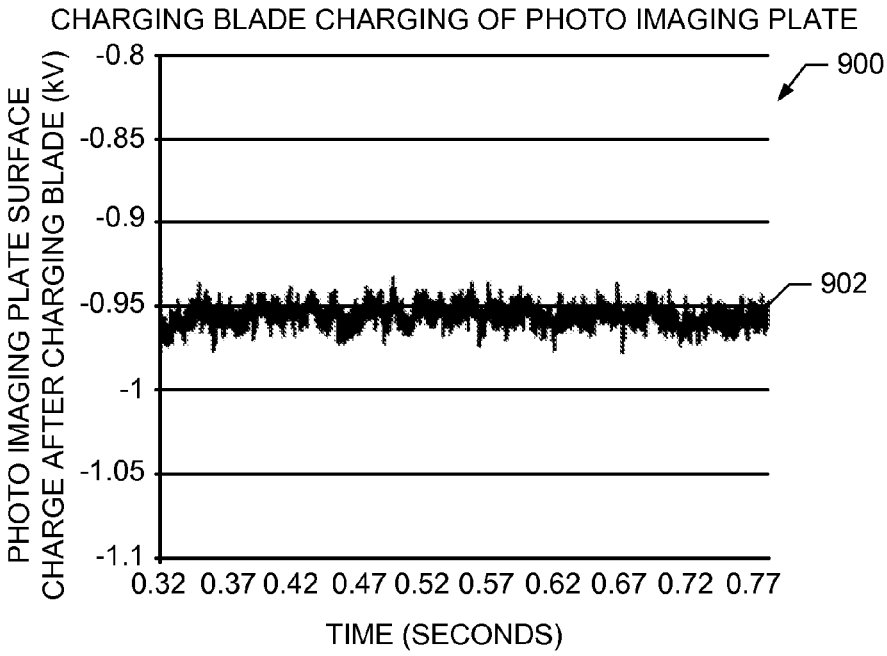
FIG. 9 is a graph of example surface charge (e.g., voltage) measured on a photo imaging plate that has been charged by a charging blade

FIG. 9 is a graph 900 of example surface charge (e.g., voltage) 902 measured on a photo imaging plate that has been charged by a charging blade (e.g., any of the charging blades 104, 204, 300, 500, 700 of FIGS. 3-7). As shown in FIG. 9, the measured surface charge 902 on the photo imaging plate is substantially uniform and does not suffer from current spikes (e.g., localized high current discharge).

Figure 10:
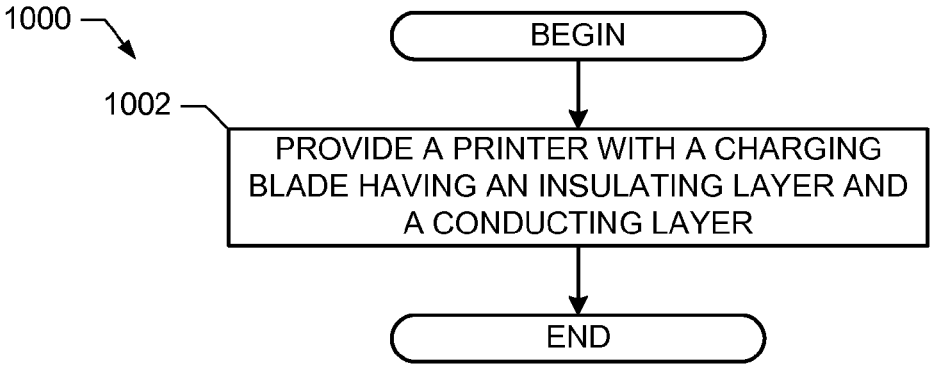
FIG. 10 is a flowchart representative of an example method to provide a printer with a charging blade.

FIG. 10 is a flowchart representative of an example method 1000 to provide a printer with a charging blade. The example method 1000 may be used to provide any of the example printers 100, 200 of FIGS. 1 and/or 2 with a charging blade, such as any of the charging blades 104, 204, 300, 500, 700 of FIGS. 1-7. In particular, the example method 1000 may be used by a retrofitter to retrofit an existing printer having a scraping blade by replacing the scraping blade with a charging blade.

The example method 1000 begins with providing a printer (e.g., the printer 100 of FIG. 1, the printer 200 of FIG. 2, etc.) with a charging blade (e.g., any of the charging blades 104, 204, 300, 500, 700 of FIGS. 1-7) having an insulating layer (e.g., the insulating layer 302 of FIG. 3) and a conductive layer (e.g., the conductive layer 304 of FIG. 3) (block 1002). For example, a retrofitter may position (e.g., install) the charging blade in the printer. The example method 1000 then ends.

In some example methods, providing the printer with the charging blade includes positioning the conductive layer 304 a distance from a contact edge of the insulating layer 302, where the insulating layer 304 contacts a photo imaging plate (e.g., the photo imaging plate 106 of FIG. 1, the photo imaging plate 208 of FIG. 2) of the printer at the contact edge.

In some examples, providing the printer with the charging blade includes attaching the conductive layer to the insulating layer. The attaching may occur prior to installing the charging blade in the printer and/or subsequent to installing the charging blade in the printer.

In some examples, the providing the printer with the charging blade includes connecting the conductive layer to a power supply and/or enabling the power supply.

Figure 11:
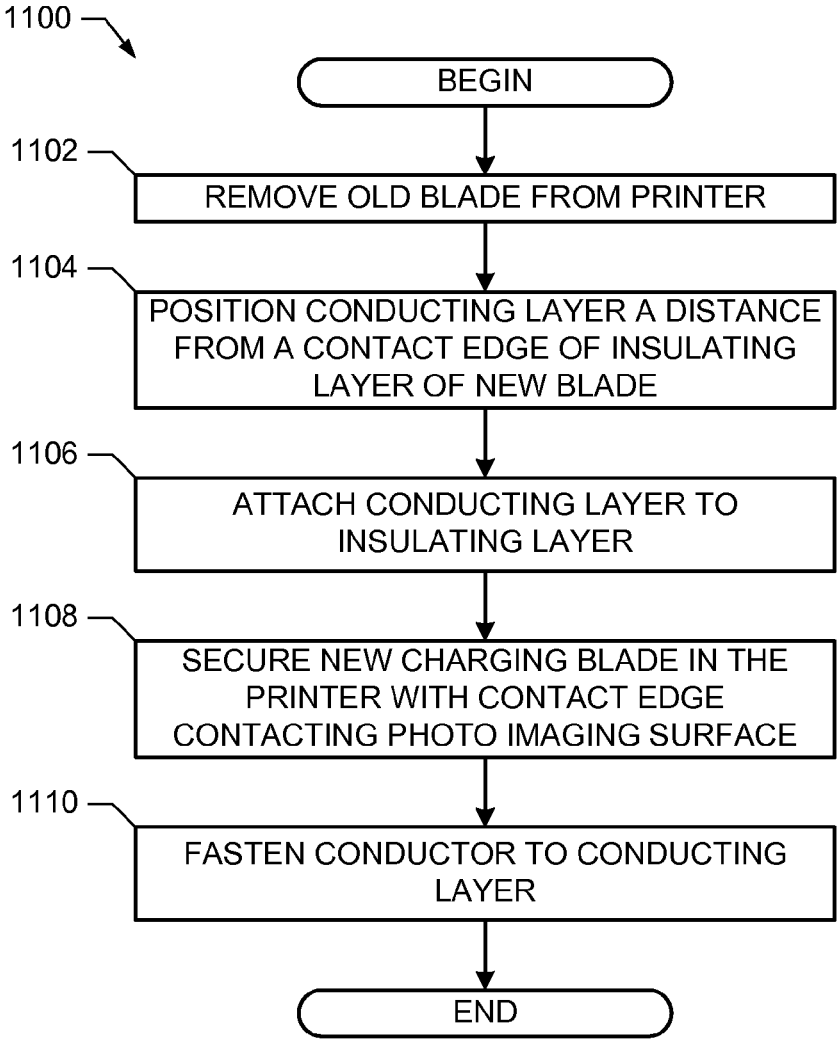
FIG. 11 is a flowchart representative of another example method to provide a printer with a charging blade.

FIG. 11 is a flowchart representative of another example method 1100 to provide a printer with a charging blade. The example method 1100 may be used to provide any of the example printers 100, 200 of FIGS. 1 and/or 2 with a charging blade, such as any of the charging blades 104, 204, 300, 500, 700 of FIGS. 1-7. In particular, the example method 1100 may be used by a retrofitter to retrofit an existing printer having a scraping blade by replacing the scraping blade with a charging blade. The example method 1100 may implement block 1002 of FIG. 10 to provide a printer with a charging blade having an insulating layer and a conductive layer. While the example method 1100 of FIG. 11 illustrates an example order of the blocks, any of the blocks may be combined, rearranged, and/or divided into multiple blocks.

The example method 1100 begins by removing an old blade (e.g., a scraping blade) from a printer (e.g., the example printers 100, 200 of FIGS. 1 and/or 2) (block 1102). A conducting layer (e.g., the conducting layer(s) 304, 504-510 of FIGS. 3-6) is positioned a distance (e.g., the distance D of FIGS. 3-6) from a contact edge (e.g., the contact edge 514 of FIG. 5) of an insulating layer (e.g., the insulating layers 302, 502 of FIGS. 3-6) of a new charging blade (block 1104).

The conducting layer 304, 504-510 is attached (e.g., fastened, glued, etc.) to the insulating layer 302, 502 (e.g., at the position of block 1104) (block 1106). The new charging blade 1108 is secured in the printer 100, 200 with the contact edge 514 of the insulating layer 302, 502 contacting a photo imaging surface (e.g., the photo imaging plates 106, 208 of FIGS. 1 and/or 2). A conductor is fastened to the conducting layer 304, 504-510 (block 1110). For example, the fastened conductor couples the conducting layer 304, 504-510 to a power supply (e.g., the power supply 216, the power supply 512 of FIGS. 2 and/or 5) to enable charging of the conducting layer 304, 504-510. The example method 1100 ends.

Figure 12:
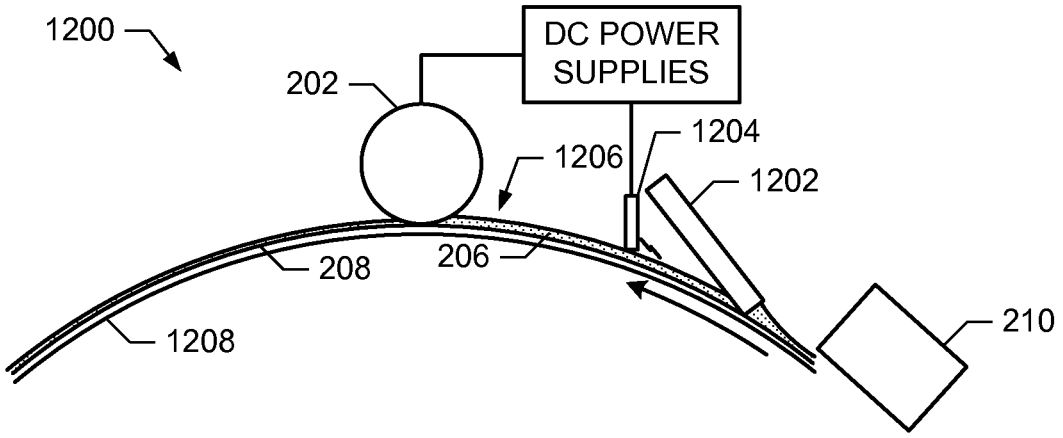
FIG. 12 illustrates another example printer constructed in accordance with the teachings of this disclosure including a charge roller, a scraping blade, a charging blade, and imaging oil.

FIG. 12 illustrates another example printer 1200 including a charge roller 202, a scraping blade 1202, a charging blade 1204, and imaging oil 206. The example printer 1200 includes the example charge roller 202, the example imaging oil 206, the example photo imaging plate 208, and the example cleaning station 210 of FIG. 2. Unlike the printer 200 of FIG. 2, the example printer 1200 the charging blade 1204 of FIG. 2 does not control an amount of oil on the photo imaging plate 208 in an area 1206 subsequent to the charging blade 1204. Instead, the example charging blade 1204 of FIG. 12 includes a conductive material (e.g., layer) to apply charge to the photo imaging plate 208. The printer 1200 further includes the scraping blade 1202 to control the amount (e.g., thickness) of the imaging oil 206 present on the photo imaging plate 208. In some examples, the charging blade 1204 does not include an insulating layer and/or includes only a conductive layer.

In the example of FIG. 12, the charging blade 1204 is in contact with the imaging oil 206 such that the charging blade 1204 is coated with the imaging oil 206. While the charging blade 1204 may apply pressure to the photo imaging plate 208 to promote contact with the imaging oil 206, the pressure applied by the example charging blade 1204 does not substantially affect the amount of imaging oil 206 on the photo imaging plate 208 as the plate 208 approaches the charge roller 202.

Like the example charging blade 204 of FIG. 2, the example charging blade 1204 of FIG. 12 applies a charge to the photo imaging plate 208. The example charge roller 202 applies a second charge to the photo imaging plate 208 to modify (e.g., increase, decrease, and/or even) the charge on the photo imaging plate 208 (e.g., the charge present on the section 1206). Thus, the example charge roller 202 modifies the charge applied to the photo imaging plate 208 by the charging blade 1204. In the example of FIG. 12, the charge applied to and/or removed from the photo imaging plate 208 by the charging roller 202 is substantially reduced, compared to the charge applied to photo imaging surfaces in known printers, and is replaced with the application of charge by the charging blade 204.

The example printer 1200 enables the separation of charging and layer thickness control into separate blades. Thus, each of the blades 1202 and 1204 may be replaced as they wear out without concurrently replacing the other.

In some examples, the photo imaging surface 208 is consumable. The example printer 1200 of FIG. 12 includes a surface 1208 to receive the photo imaging surface 208 and/or supports the photo imaging surface 208, which is adjacent the surface 208 when installed. Thus, the example charging blades 104, 204, 300, 500, 700, and/or 1204 may be positioned in the printer 1200 adjacent the surface 1208 (e.g., when the photo imaging surface 208 is not present at the time of installation of the charging blade). The example photo imaging surface 208 may be introduced and/or replaced after the charging blade 1204 has been positioned in the printer 1200. In some examples, the surface 1208 shares substantially the same travel path as the photo imaging surface 208 and, thus, the charge roller 202 is located downstream of the charging blade 1204 in the travel directions of both the photo imaging surface 208 and the surface 1208.

Figure 13:
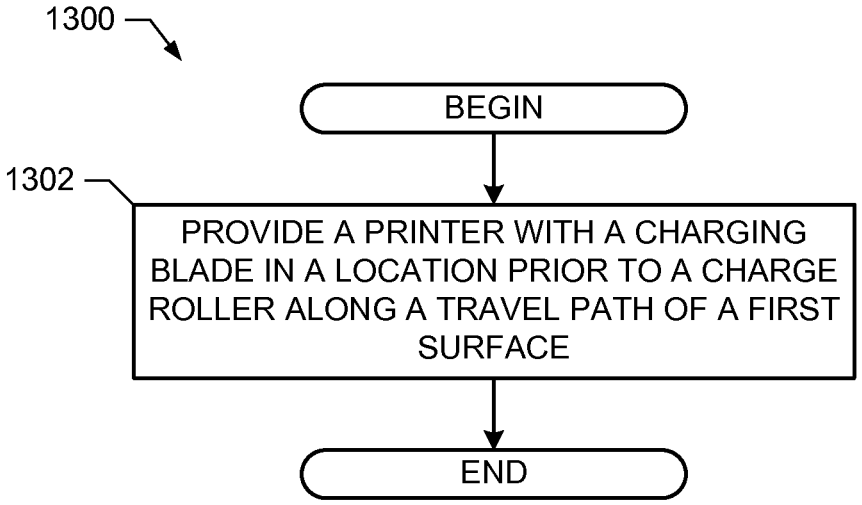
FIG. 13 is a flowchart representative of another example method to provide a printer with a charging blade.

FIG. 13 is a flowchart representative of an example method 1300 to provide a printer with a charging blade. The example method 1300 may be used to provide any of the example printers 100, 200, 1200 of FIGS. 1, 2, and/or 12 with a charging blade, such as any of the charging blades 104, 204, 300, 500, 700, 1204 of FIGS. 1-7 and/or 12.

The example method 1300 includes providing a printer (e.g., the printer 1200 of FIG. 12) with a charging blade (e.g., the charging blade 1204) in a location prior to a charge roller (e.g., the charge roller 202 of FIG. 12) along a travel path of a first surface (e.g., the surface 1208) (block 1302). In the example method 1300, the charging blade 1204 includes a conductive layer to be charged and to apply a first charge to a photo imaging surface (e.g., the photo imaging surface 208) adjacent the first surface 1208. The example method 1300 may then end.

In some example methods, the charging blade 1204 is provided subsequent to a scraping blade (e.g., the scraping blade 1202) along a travel path of the first surface (e.g., the surface 1208) and/or a photo imaging surface (e.g., the photo imaging surface 208). In some example methods, the charging blade 1204 further comprises an insulating layer to contact the photo imaging surface 208 at an angle to apply pressure to the photo imaging surface 208. The pressure applied by the insulating layer is to control an amount of material (e.g., imaging oil 206) present on the photo imaging surface 208.

At least some examples of charging blades disclosed herein are inexpensive to fabricate compared to known charge rollers. When used in combination with a charge roller in a printer, the charging blades may provide charging of a photo imaging surface without the requirement to charge uniformly. The examples disclosed above facilitate extending the lifetime of charge rollers for the known printers. Example charging blades, printers, and methods to provide printers with charging blades can reduce the cost per page for printers using the charge rollers by as much as 6%. Furthermore, the example charging blades, printers, and methods to provide printers with charging blades provide charge uniformity on a photo imaging surface that is greater than can be achieved via charging with only a charge roller.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A charging blade for a printer, comprising:

an insulating layer to contact a photo imaging surface at an angle to apply pressure to the photo imaging surface, the pressure to control an amount of a first material present on the photo imaging surface, the insulating layer to contact the photo imaging surface at a contact edge; and a conductive layer attached to a side of the insulating layer to face the photo imaging surface when the contact edge is in contact with the photo imaging surface, the conductive layer positioned a distance from the contact edge of the insulating layer such that the conductive layer does not contact the photo imaging surface, the conductive layer to be charged and to apply a first charge to the photo imaging surface.

2. A charging blade as defined in claim 1, wherein the conductive layer is to be coated with the first material during operation of the printer, the printer including the photo imaging surface.

3. A charging blade as defined in claim 1, wherein the conductive layer is to be coated with the first material, the first material to provide a dielectric layer between the conductive layer and the photo imaging surface.

4. A charging blade as defined in claim 3, wherein the dielectric layer is to prevent localized high current discharge between the conductive layer and the photo imaging surface.

5. A charging blade as defined in claim 1, wherein the insulating layer is to apply the pressure to control a thickness of a layer of the first material on the photo imaging surface, the first material comprising petroleum hydrocarbon imaging oil.

6. A charging blade as defined in claim 1, wherein the conductive layer is a metal.

7. A charging blade as defined in claim 6, wherein the conductive layer is to apply the first charge without causing an uneven charging pattern on the photo imaging surface.

8. A charging blade for a printer, comprising:

an insulating layer to contact a photo imaging surface at an angle to apply pressure to the photo imaging surface, the pressure to control an amount of material present on the photo imaging surface; and a conductive layer attached to a side of the insulating layer, the conductive layer to be charged and to apply a first charge to the photo imaging surface, wherein the charging blade is to apply the first charge partially via plasma discharge and partially via ionic conduction.

9. A printer, comprising:

a charging blade to apply a first charge to a photo imaging surface and to control a layer thickness of an imaging oil on the photo imaging surface; and a charge roller downstream of the charging blade in a direction of movement of the photo imaging surface to modify the first charge on the photo imaging surface.

10. A printer as defined in claim 9, wherein the first charge is larger than a second charge applied by the charge roller.

11. A printer as defined in claim 9, wherein the charging blade is to be at least partially coated by the imaging oil, the imaging oil to provide a dielectric layer between the charging blade and the photo imaging surface.

12. A printer as defined in claim 11, wherein coating of the charging blade by the imaging oil is to occur during operation of the printer.

13. A printer as defined in claim 9, wherein the charging blade comprises a conductive material, the conductive material to control an amount of the imaging oil present on the photo imaging surface and to apply the first charge to the photo imaging surface.

14. A printer as defined in claim 9, wherein the charging blade comprises:

an insulating layer to control the thickness of the layer of imaging oil; and a conductive layer attached to a side of the insulating layer that faces the photo imaging surface, the conductive layer positioned a distance from a contact edge of the insulating layer such that the conductive layer does not contact the photo imaging surface.

15. A printer, comprising:

a charging blade to apply a first charge to a photo imaging surface, wherein the charging blade is to apply the first charge partially via plasma discharge and partially via ionic conduction; and a charge roller downstream of the charging blade in a direction of movement of the photo imaging surface to modify the first charge on the photo imaging surface.

16. A method, comprising:

installing a charging blade in a printer at a location in the printer that is prior to a charge roller along a travel path of a photo imaging surface of the printer; and coupling a conductive layer of the charging blade to a power supply, the charging blade to be charged to apply a first charge to the photo imaging surface, and, when installed, the charging blade positioned to contact the photo imaging surface at an angle to apply pressure to the photo imaging surface, the charging blade to control a layer thickness of an imaging oil on the photo imaging surface.

17. A method as defined in claim 16, wherein the conductive layer of the charging blade is attached to a side of an insulating layer of the charging blade.

18. A method as defined in claim 17, wherein the conductive layer is located a distance from a contact edge of the insulating layer, the insulating layer to contact the photo imaging surface at the contact edge.

19. A method as defined in claim 17, further comprising attaching the conductive layer to the insulating layer.

* * * * *

UNITED STATES PATENT AND TRADEMARK OFFICE

CERTIFICATE OF CORRECTION

PATENT NO. : 8,892,005 B2
APPLICATION NO. : 13/459509
DATED : November 18, 2014
INVENTOR(S) : Quang P. Lam et al.

It is certified that error appears in the above-identified patent and that said Letters Patent is hereby corrected as shown below:

On the Title page, in item (75), Inventors, in column 1, line 6, delete "Pennsgrove," and insert -- Penngrove, --, therefor.

Signed and Sealed this
Fourteenth Day of April, 2015

Michelle K. Lee

Michelle K. Lee
*Director of the United States Patent and Trademark Office*